US008005399B2

(12) United States Patent
Sahara

(10) Patent No.: US 8,005,399 B2
(45) Date of Patent: Aug. 23, 2011

(54) IMAGE FORMING APPARATUS WITH INTEGRAL UNIT OF FIXING UNIT AND REVERSE ROLLERS IN MAIN BODY

(75) Inventor: Hiroshi Sahara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 96 days.

(21) Appl. No.: 12/512,351

(22) Filed: Jul. 30, 2009

(65) Prior Publication Data

US 2010/0034559 A1 Feb. 11, 2010

(30) Foreign Application Priority Data

Aug. 5, 2008 (JP) ..... 2008-201947

(51) Int. Cl.
*G03G 15/20* (2006.01)

(52) U.S. Cl. ..... 399/122

(58) Field of Classification Search ..... 399/122, 399/124, 328, 401; 219/216
See application file for complete search history.

(56) References Cited

U.S. PATENT DOCUMENTS

| | | | | |
|---|---|---|---|---|
| 4,571,056 | A * | 2/1986 | Tani et al. | 399/122 |
| 6,324,358 | B1 | 11/2001 | Sahara | 399/66 |
| 6,757,502 | B2 * | 6/2004 | Yoshikawa | 399/22 |
| 6,970,665 | B2 | 11/2005 | Kuma et al. | 399/90 |
| 7,020,431 | B2 | 3/2006 | Sahara | 399/400 |
| 7,164,874 | B2 | 1/2007 | Kuma et al. | 399/90 |
| 7,176,952 | B2 * | 2/2007 | Ishida et al. | 347/156 |
| 7,274,903 | B2 * | 9/2007 | Carter et al. | 399/320 |
| 7,313,344 | B2 | 12/2007 | Kuma et al. | 399/111 |
| 7,496,316 | B2 * | 2/2009 | Ito et al. | 399/122 |
| 7,564,573 | B2 * | 7/2009 | Chung et al. | 358/1.12 |
| 2008/0279601 | A1 | 11/2008 | Sahara et al. | 399/401 |

FOREIGN PATENT DOCUMENTS

| | | | |
|---|---|---|---|
| JP | 08087227 | A * | 4/1996 |
| JP | 11-288140 | | 10/1999 |
| JP | 2003316087 | A * | 11/2003 |
| JP | 2004-151389 | | 5/2004 |
| JP | 2008-8950 | | 1/2008 |

* cited by examiner

*Primary Examiner* — Robert Beatty
(74) *Attorney, Agent, or Firm* — Fitzpatrick, Cella, Harper & Scinto

(57) ABSTRACT

An image forming apparatus includes: has a main body; an image forming portion for forming a toner image on a recording material; a fixing unit for fixing the toner image on the recording material and including a nip forming member which forms a fixing nip that nips and fixes and conveys the recording material; a reverse roller unit for including a reverse roller, and the reverse roller rotates backward to convey the recording material to the image forming portion again after conveying the recording material which has passed through the fixing nip in a same direction as a conveying direction at the fixing nip; and a delivery roller for delivering the recording material which has passed through the fixing nip, out of the main body. The reverse roller unit is attached to the fixing unit, and is removably installable in the main body integrally with the fixing unit and the main body includes a first positioning portion and a second positioning portion, and when an integral unit of the fixing unit and the reverse roller unit is installed in the main body, the fixing unit is positioned with respect to the first positioning portion, and the reverse roller unit is positioned with respect to the second positioning portion.

1 Claim, 8 Drawing Sheets

IMAGE FORMING APPARATUS WITH INTEGRAL UNIT OF FIXING UNIT AND REVERSE ROLLERS IN MAIN BODY

BACKGROUND OF THE INVENTION

1. Field of the Invention

The present invention relates to an image forming apparatus that adopts electrostatic recording, electrophotographic recording, and the like, and in particular relates to an image forming apparatus that includes a reverse unit for reversing a recording material which has passed through a fixing unit.

2. Description of the Related Art

A full color image forming apparatus with an intermediate transfer system is described below with reference to FIG. 10, as an example of an image forming apparatus relating to the present invention.

In recent years, with the progress of downsizing and sophistication of image forming apparatuses, an image forming apparatus having a structure described below has been developed (for example, see Japanese Patent Application Laid-Open No. 2004-151389 (p. 12, FIG. 1)).

As illustrated in FIG. 10, the image forming apparatus includes a plurality of image forming portions 110. The plurality of image forming portions 110 forms latent images on photosensitive drums 111 which are image bearing members by using light, magnetism, an electric charge, or the like, and visualizes the latent images to obtain visible images. An intermediate transfer member 130 to which the visible images are sequentially transferred from the each image forming portion to form a multicolor image is located above the image forming portions 110. A transfer means 136 transfers the multicolor image on the intermediate transfer member 130 to a recording material P, and a fixing device 140 fixes the multicolor image transferred to the recording material P, on the recording material P.

A feeding portion 120 for conveying the recording material P to a transfer portion Te, the manual feed tray portion 171 and the sheet feeding cassette portion 121 for supplying the recording material P to the feeding portion 120 are each disposed below the transfer means 136.

The intermediate transfer member 130 uses an intermediate transfer belt 131 which is a rotating endless belt extended between a plurality of rollers. An exposure device 106 is located close to and below the plurality of image forming portions 110. The visible images formed on the photosensitive drums 111 by the exposure device 106 are primarily transferred onto the intermediate transfer member 130 by primary transfer charging devices 135. The primary transfer charging devices 135 are disposed so as to face the image forming portions 110 and the intermediate transfer member 130. The visible images primarily transferred from the plurality of photosensitive drums 111 are overlaid one on top of another on the intermediate transfer member 130, and the intermediate transfer member 130 rotates to convey the overlaid visible image to the position Te where the image is transferred to the recording material P. The visible image on the intermediate transfer member 130 is secondarily transferred onto the recording material P selected and fed from the manual feed tray portion 171 or the sheet feeding cassette portion 121, at the secondary transfer position Te by the secondary transfer roller 136. The secondarily transferred visible image is then fixed by the fixing device 140, as a result of which a full color image is obtained.

The image forming apparatus described above can be downsized significantly, because a paper passing path of the recording material P is short and each unit is compactly arranged. Moreover, a time period from sheet feeding to output can be shortened, which contributes to higher speed. Furthermore, the short sheet passing path reduces an occurrence frequency of a jam such as a sheet jam, so that a high-quality image forming apparatus can be realized.

A delivery roller pair 150, a delivery tray 160, and a duplex conveying path 170 are disposed downstream of the fixing device 140 in a conveying direction. The recording material P which has passed through the fixing device 140 is delivered to the delivery tray 160 via the delivery roller pair 150, in the case of simplex printing or after printing on the second side in the case of duplex printing. The following describes an operational procedure of the delivery roller pair 150 in the case where the recording material P which has passed through the fixing device 140 is the first side in duplex printing, with reference to FIGS. 11 and 12.

FIGS. 11 and 12 are schematic enlarged views of the fixing and delivery parts in FIG. 10. A delivery guide 145, a flapper 146, a delivery roller pair 150 made up of delivery rollers 151*a* and 151*b*, and a duplex conveying path 170 are provided downstream of a fixing nip FN in a conveying direction. The flapper 146 is rotatable, and is biased downward under its own weight. The delivery rollers 151*a* and 151*b* can rotate forward and backward.

A reverse movement of the recording material P after the printing on the first side in duplex printing ends is described below. In FIG. 11, having passed through the fixing nip FN, the recording material P is conveyed to the delivery roller pair 150 via the conveying guide 145. The delivery roller pair 150 rotates in a direction of an arrow E, to convey the recording material P which has passed through the fixing nip FN until a rear end of the recording material P completely comes out of the fixing nip FN. The recording material P is conveyed while pushing up the flapper 146 which is placed in the conveying guide 145 and biased in a gravitational direction under its own weight.

After the rear end P2 of the recording material P completely passes through the flapper 146, the delivery rollers 151*a* and 151*b* rotate backward in a direction of an arrow F as illustrated in FIG. 12, to convey the recording material P to the duplex conveying guide 170. Having been conveyed to the duplex conveying guide 170, the recording material P is conveyed to the transfer unit again, in order to print on the second side in duplex printing.

Such a structure in which the delivery roller pair is disposed immediately downstream of the fixing unit and the sheet conveying direction is changed between simplex printing and duplex printing by the forward and backward rotation of the delivery roller pair contributes to component simplification and apparatus downsizing.

However, the following problem arises in the image forming apparatus shown in the above-mentioned conventional example. In the case of continuously printing a plurality of recording materials in duplex printing, while the delivery roller pair is rotating backward to convey one recording material to the duplex conveying guide, the next recording material cannot advance into the delivery roller pair. Accordingly, an interval (hereafter referred to as a sheet interval) between one recording material and the next recording material in continuous sheet passing needs to be approximately as long as a result of subtracting a distance between the fixing unit and the delivery unit from a length of the recording material in a sheet passing direction. This causes a significant decrease in productivity.

In view of the above-mentioned problem, Japanese Patent Application Laid-Open No. 2008-008950 (p. 9, FIG. 1) proposes a structure of separately providing a delivery roller pair and a reverse roller pair. According to the structure of this patent document, even when continuously printing a plurality of recording materials in duplex printing, delivery and reversal can be performed approximately at the same time. This enables the sheet interval to be minimized, thereby enhancing the productivity.

However, in the proposed structure of Japanese Patent Application Laid-Open No. 2008-008950 (p. 9, FIG. 1), the fixing unit and the reverse roller pair are installed in the image forming apparatus independently of each other. This causes deterioration in alignment of the fixing unit and the reverse roller pair, depending on precision of a plurality of components. When the alignment of the fixing unit and the reverse roller pair deteriorates, in a state where the recording material is sandwiched by the fixing unit and the reverse rollers, the recording material is caused to form a deviated loop between the fixing unit and the reverse roller pair. Besides, an excessively large deviated loop may induce a sheet jam in the conveying guide. Even if the deviated loop is not so large as to induce a sheet jam, when the rear end of the recording material passes through the fixing unit and is reversed by the reverse roller pair, the amount of deviated loop directly becomes the amount of skew feeding of the recording material. The recording material is conveyed to the duplex conveying guide in a skew feeding state and the second side in duplex printing is printed, as a result of which an image of the second side is printed askew on the recording material.

For precise alignment of the fixing unit and the reverse roller pair, it is necessary to increase the precision of each component. This makes component management in mass production difficult, and also leads to an increase in cost. The effect on the alignment precision of the fixing unit and the reverse roller pair can be reduced by providing a structure of correcting the skew fed recording material before printing on the second side. However, this requires a new component to be added, which hinders apparatus downsizing and also causes a cost increase due to an increased number of components.

SUMMARY OF THE INVENTION

The present invention was conceived in view of the problems mentioned above. An object of the present invention is to provide an image forming apparatus that can prevent a decrease in printing precision, while ensuring productivity when duplex-printing a plurality of recording materials. Another object of the present invention is to provide an image forming apparatus including: a main body; an image forming portion for forming a toner image on a recording material; a fixing unit for fixing the toner image on the recording material and including a nip forming member which forms a fixing nip that nips and conveys the recording material; a reverse roller unit for including a reverse roller, and the reverse roller rotates backward to convey the recording material to the image forming portion again after conveying the recording material which has passed through the fixing nip in a same direction as a conveying direction at the fixing nip; and a delivery roller for delivering the recording material which has passed through the fixing nip, out of the main body, wherein the reverse roller unit is attached to the fixing unit, and is removably installable in the main body integrally with the fixing unit.

Further features of the present invention will become apparent from the following description of an exemplary embodiment with reference to the attached drawings.

DESCRIPTION OF THE EMBODIMENT

A preferred embodiment of the present invention will now be described in detail in accordance with the accompanying drawings.

First Embodiment

Figure 3:
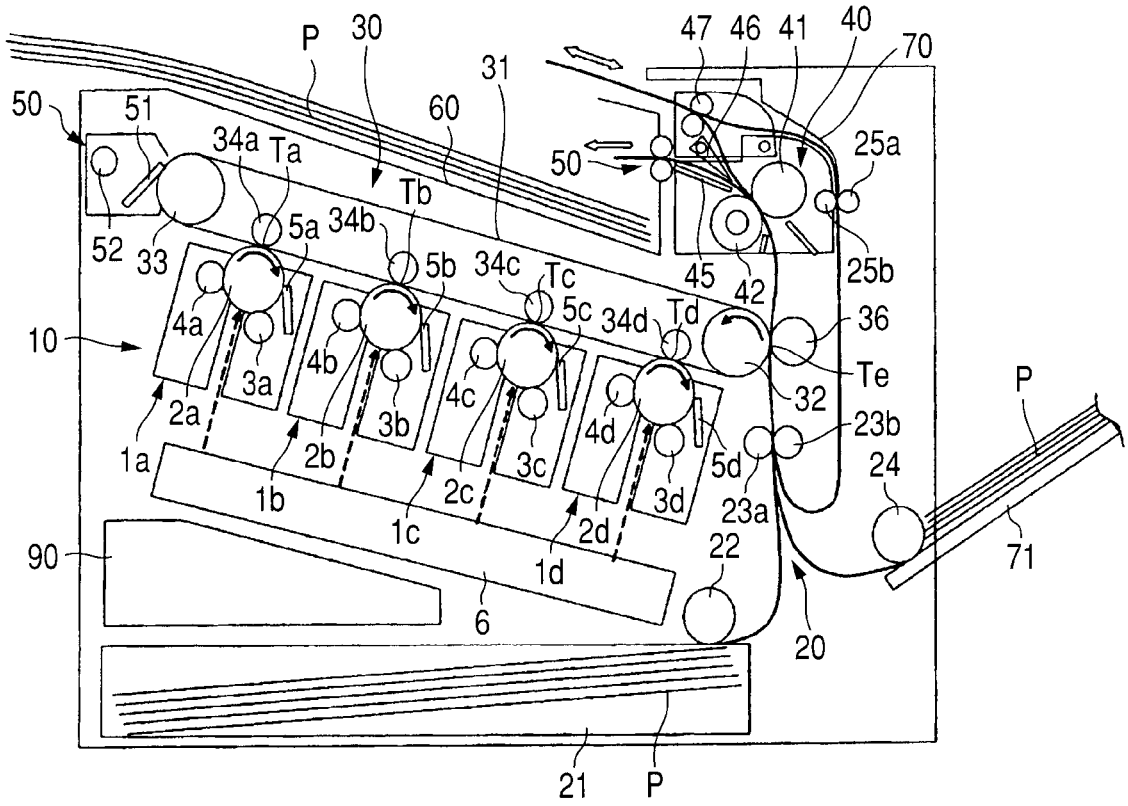
FIG. 3 is a schematic sectional view of the image forming apparatus in the embodiment of the present invention.

A rough structure of an image forming apparatus in an embodiment of the present invention is described below, with reference to FIG. 3. The image forming apparatus in this embodiment is a color image forming apparatus that uses an electrophotographic imaging process.

The image forming apparatus includes, in an image forming apparatus main body 10, image forming portions 1*a* to 1*d* for forming an image on a recording material, and a fixing unit 40A as a fixing portion for fixing the image formed by the image forming portions 1*a* to 1*d* on the recording material P.

The image forming portions 1*a* to 1*d* are four image forming portions that respectively form images of colors of yellow, magenta, cyan, and black. The four image forming portions 1*a*, 1*b*, 1*c*, and 1*d* are arranged in a row at fixed intervals.

Drum-type electrophotographic photosensitive members (hereafter referred to as photosensitive drums) 2*a*, 2*b*, 2*c*, and 2*d* as image bearing members are provided respectively in the image forming portions 1*a*, 1*b*, 1*c*, and 1*d*. Chargers 3*a*, 3*b*, 3*c*, and 3*d*, developing devices 4*a*, 4*b*, 4*c*, and 4*d*, and drum cleaning devices 5*a*, 5*b*, 5*c*, and 5*d* are disposed around the photosensitive drums 2*a*, 2*b*, 2*c*, and 2*d*, respectively. An exposure device 6 is provided below the image forming portions 1*a*, 1*b*, 1*c*, and 1*d*. The developing devices 4*a*, 4*b*, 4*c*, and 4*d* contain yellow toner, magenta toner, cyan toner, and black toner, respectively.

Each of the photosensitive drums 2*a*, 2*b*, 2*c*, and 2*d* is a negatively charged OPC photosensitive member, has a photoconductive layer on a drum substrate made of aluminum, and is rotated by a driving device (not illustrated) at a predetermined process speed in a direction of an arrow (clockwise). The chargers 3*a*, 3*b*, 3*c*, and 3*d* as a charging means respectively charge surfaces of the photosensitive drums 2*a*, 2*b*, 2*c*, and 2*d* uniformly to a predetermined potential of negative polarity, by charge biases applied from a charge bias power supply (not illustrated).

The developing devices 4*a*, 4*b*, 4*c*, and 4*d* deposit the respective colors of toner on electrostatic latent images formed on the photosensitive drums 2*a*, 2*b*, 2*c*, and 2*d*, to develop (visualize) the electrostatic latent images as toner images. As a method of development by the developing devices 4*a*, 4*b*, 4*c*, and 4*d*, a two-component contact development method can be used. For example, in the two-component contact development method, a mixture of toner particles and a magnetic carrier is used as a developer and conveyed by a magnetic force, and is subject to development in a contact state with each of the photosensitive drums 2*a*, 2*b*, 2*c*, and 2*d*.

Primary transfer rollers 34*a*, 34*b*, 34*c*, and 34*d* as a transfer means are formed of elastic members, and are in contact with the photosensitive drums 2*a*, 2*b*, 2*c*, and 2*d* at respective transfer nips via an intermediate transfer belt 31 in an endless belt form. Though the transfer rollers 34*a*, 34*b*, 34*c*, and 34*d* are used as the transfer means here, transfer blades to which a high voltage is applied when transferring a toner image to a recording material and which are in contact with the intermediate transfer belt 31 may be used instead.

The drum cleaning devices 5*a*, 5*b*, 5*c*, and 5*d* remove and recover residual transfer toner left on the surfaces of the photosensitive drums 2*a*, 2*b*, 2*c*, and 2*d*, respectively.

The exposure device 6 uses laser light that is modulated according to a time-series electrical digital pixel signal of image information. The surfaces of the photosensitive drums 2*a*, 2*b*, 2*c*, and 2*d* are exposed to laser light output from a laser output portion (not illustrated), via a high-speed rotating polygon mirror (not illustrated) or the like. As a result, the electrostatic latent images of the respective colors according to the image information are formed on the surfaces of the photosensitive drums 2*a*, 2*b*, 2*c*, and 2*d* charged by the chargers 3*a*, 3*b*, 3*c*, and 3*d*.

A feeding unit 20 includes a sheet feeding cassette 21, a cassette feeding roller 22, resist rollers 23*a* and 23*b*, a manual feed tray feeding roller 24, and a manual feed tray 71. The recording material P in the sheet feeding cassette 21 or on the manual feed tray 71 is selected and fed, and conveyed to a secondary transfer portion Te.

An intermediate transfer unit 30 includes the intermediate transfer belt 31. The intermediate transfer belt 31 is extended between a drive roller 32 and a tension roller 33, and driven by the drive roller 32 to rotate (move) in a direction of an arrow (counterclockwise). The intermediate transfer belt 31 is made of a dielectric resin such as polycarbonate, a polyethylene terephthalate resin film, or a polyvinylidene fluoride resin film. An intermediate transfer belt cleaning device 50 is installed on an opposite side of the tension roller 33, with the intermediate transfer belt 31 in between.

The intermediate transfer belt cleaning device 50 includes a cleaning blade 51 that is made of an elastic material and contacts the intermediate transfer belt at a predetermined pressure, and a conveying screw 52 that conveys residual toner removed from the intermediate transfer belt 31 by the cleaning blade 51. By the conveying screw, the residual toner is conveyed to a toner container (not illustrated).

The fixing unit 40A as a fixing portion is disposed downstream of the secondary transfer portion Te, and a delivery unit 50 is disposed further downstream in a sheet passing direction. A delivery tray 60 for stacking the recording material P delivered by the delivery unit 50 is disposed downstream of the delivery unit 50 in the sheet passing direction and above the intermediate transfer unit 30.

The fixing unit 40A includes a fixing roller 42 and a pressure roller 41 as a fixing means. The fixing roller 42 contains a heat source. In this embodiment, the fixing roller 42 and the pressure roller 41 correspond to a nip forming member. However, a nip forming member of another structure such as the use of a fixing belt is also applicable.

A power supply unit 90 is located below the exposure device 6 and above the sheet feeding cassette 21.

An image forming operation by the above-mentioned image forming apparatus is described below.

Upon issuance of an image formation start signal, the photosensitive drums 2*a*, 2*b*, 2*c*, and 2*d* of the image forming portions 1*a*, 1*b*, 1*c*, and 1*d* which are rotated at the predetermined process speed are uniformly negatively charged by the chargers 3*a*, 3*b*, 3*c*, and 3*d*, respectively. The exposure device 6 converts an image signal of an output image to an optical signal in the laser output portion (not illustrated), and scans and exposes the charged photosensitive drums 2*a*, 2*b*, 2*c*, and 2*d* to laser light which is the converted optical signal, thereby forming electrostatic latent images.

First, yellow toner is deposited on the electrostatic latent image formed on the photosensitive drum 2*a*, by the developing device 4*a* to which a developing bias of the same polarity as the charge polarity (negative polarity) of the photosensitive drum 2*a* is applied. As a result, the electrostatic latent image is visualized as a toner image. In a primary transfer portion Ta, the yellow toner image is transferred onto the intermediate transfer belt 31 by the primary transfer roller 34*a* to which a transfer bias (of the opposite polarity (positive polarity) to the toner) is applied.

The intermediate transfer belt 31 on which the yellow toner image has been transferred is moved to the image forming portion 1*b* by the drive roller 32. In a primary transfer portion Tb composed of the image forming portion 1*b* and the primary transfer roller 34*b*, a magenta toner image formed on the photosensitive drum 2*b* is overlaid on the yellow toner image on the intermediate transfer belt 31 and transferred, in the same manner as above. Subsequently, in the same manner, a cyan toner image and a black toner image formed on the photosensitive drums 2*c* and 2*d* of the image forming portions 1*c* and 1*d* are sequentially overlaid on the yellow and magenta toner images overlaid and transferred on the intermediate transfer belt 31, respectively in primary transfer portions Tc and Td. Thus, a full color toner image is formed on the intermediate transfer belt 31.

At timing when a leading end of the toner image on the intermediate transfer belt 31 is moved to the secondary transfer portion Te, the recording material P fed from the sheet feeding cassette 21 or the manual feed tray 71 is conveyed to the transfer portion Te by the resist rollers 23*a* and 23*b*. The full color toner image is transferred onto the recording material P conveyed to the secondary transfer portion Te, by a secondary transfer roller 36 to which a transfer bias (of the opposite polarity (positive polarity) to the toner) is applied.

The recording material P on which the full color toner image has been formed is conveyed to the fixing unit 40A as an image heating device, and the full color toner image is heated and pressurized at a fixing nip between the fixing roller 42 and the pressure roller 41. After the full color toner image is heat-fixed on the surface of the recording material P, the recording material P is delivered to the delivery tray 60 on outside of the apparatus by the delivery unit 50. This completes the image forming operation.

The following describes characteristic parts in this embodiment, with reference to FIGS. 1, 2, 4, and 5. FIGS. 1, 2, 4, and 5 are enlarged schematic sectional views of the fixing unit 40A, a reverse roller unit 40B, the delivery unit 50, and their vicinity in the image forming apparatus.

Figure 1:
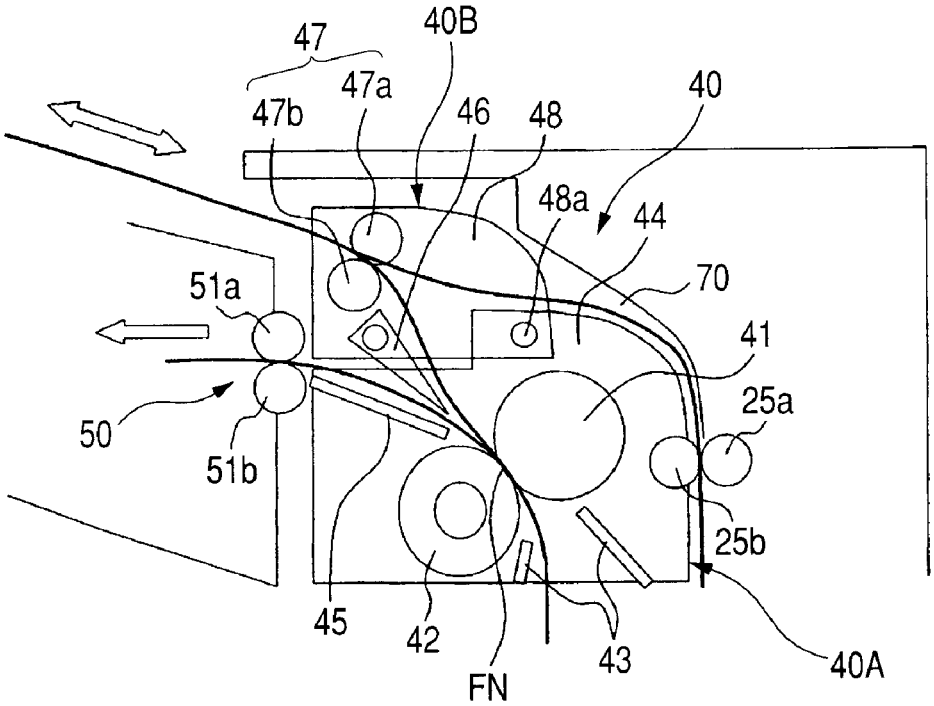
FIG. 1 is a schematic sectional view of an image forming apparatus in an embodiment of the present invention, and specifically a sectional view of a fixing unit, a reverse roller unit, a delivery roller unit, and their vicinity.
Figure 2:
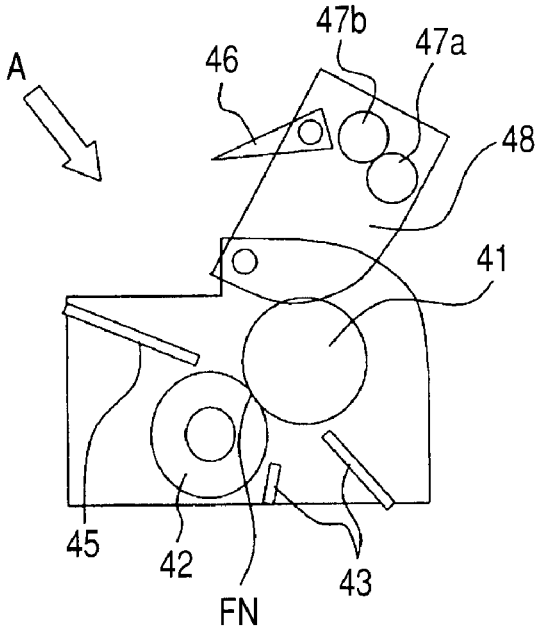
FIG. 2 is a sectional view illustrating a state where the delivery roller unit is released from the fixing unit.

In FIG. 1, the reverse roller unit 40B includes a reverse roller unit frame 48 as a reverse means holding member that holds a reverse roller pair 47 as a reverse means that reverses a recording material after fixing to return the recording material back into the image forming apparatus main body. This reverse roller unit frame 48 is rotatably connected integrally with the fixing unit 40A via a rotating shaft 48*a* as a connecting means. That is, the reverse roller unit is attached to the fixing unit. The fixing unit 40A is removably installable in the image forming apparatus main body 10, integrally with the reverse roller unit 40B. A unit (integral unit) 40 is a combination of the fixing unit 40A and the reverse roller unit 40B. The fixing unit 40A includes, as a fixing means, the fixing roller 42 as a fixing member that contains a heating element, and the pressure roller 41 as a pressure member that is pressed against the fixing roller 42 to form the fixing nip FN. The fixing roller 42 and the pressure roller 41 are rotatably attached to a fixing unit frame 44. Moreover, the reverse roller unit frame 48 is rotatable about the connecting shaft 48*a*, until the fixing nip FN between the fixing roller 42 and the pressure roller 41 which are the fixing means is exposed as illustrated in FIG. 2.

An entrance guide 43 is disposed in the fixing unit frame 44, upstream of the fixing nip FN. The delivery unit 50 located downstream of the fixing unit 40A includes delivery rollers 51*a* and 51*b*. The delivery unit 50 is fixed to the image forming apparatus main body.

The reverse unit (reverse roller unit) 40B includes the reverse roller pair 47 as a reverse means that is located downstream of the fixing nip FN and is capable of forward and backward rotation, and the reverse roller unit frame 48 that holds the reverse roller pair 47. The reverse roller pair 47 is composed of one pair of reverse rollers 47*a* and 47*b*. The reverse means is not limited to a roller pair, and may instead be other means such as a belt. The reverse roller unit frame 48 is provided with a flapper 46 which is a conveying guide for guiding the reversed recording material to a duplex conveying path 70 in the image forming apparatus main body 10 when the recording material P is reversed by the reverse roller pair 47. The flapper 46 is rotatable. This enables switching to be made between two positions, namely, a position for guiding the leading end of the recording material P from the fixing nip FN to the reverse roller pair 47 and a position for guiding a rear end (rear end in the conveying direction during the fixing process) of the recording material P from the reverse roller pair 47 to the duplex conveying path 70.

Figure 4:
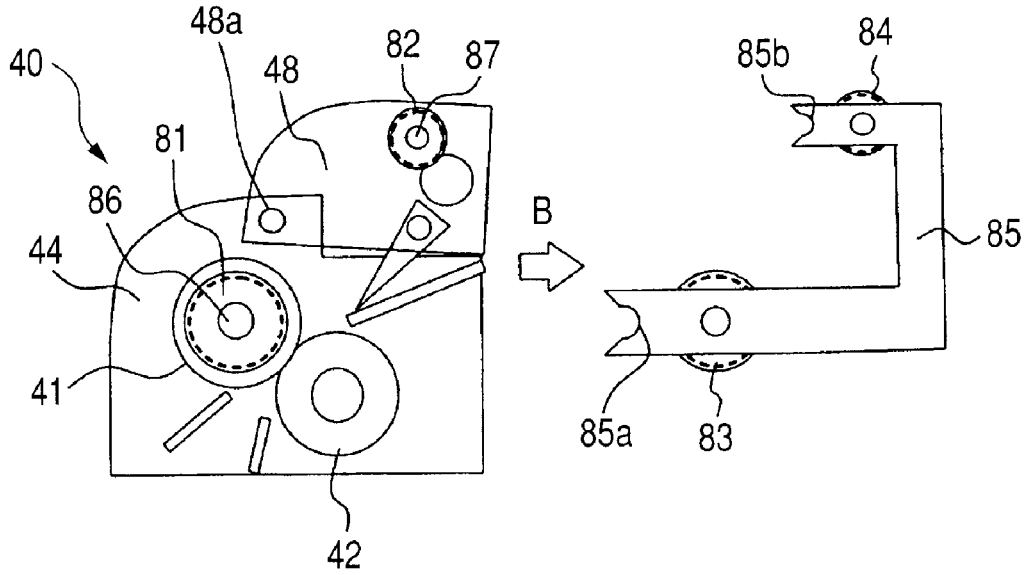
FIG. 4 is a sectional view illustrating a state before an integral unit of the fixing unit and the reverse roller unit is installed in an image forming apparatus main body.
Figure 5:
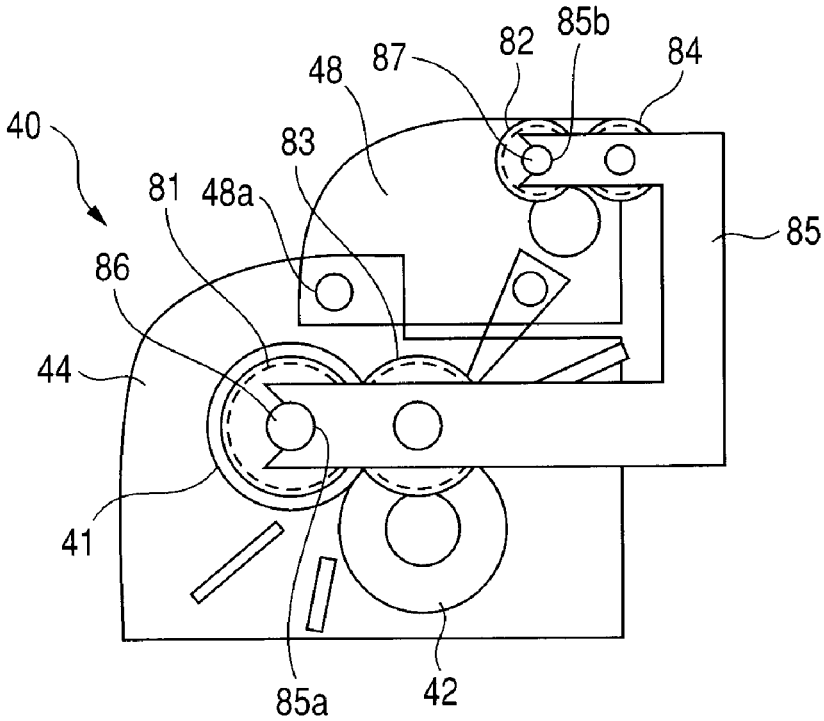
FIG. 5 is a sectional view illustrating a state after the integral unit of the fixing unit and the reverse roller unit is installed in the image forming apparatus main body.

The following describes a state where the unit 40 is installed in the image forming apparatus, with reference to FIGS. 4 and 5. FIGS. 4 and 5 are schematic sectional views when the unit 40 in FIG. 1 is seen from the opposite side (from the back of the sheet surface of FIG. 1).

FIG. 4 illustrates a state before the unit 40 is installed in the image forming apparatus main body. A pressure roller drive gear 81 is disposed coaxially with the pressure roller 41 of the fixing unit 40A, and a reverse roller drive gear 82 is disposed coaxially with the reverse roller 47*a* on the drive side (see FIG. 1).

On the image forming apparatus main body 10 side, a drive source (not illustrated) of the pressure roller 41 and the fixing roller 42 which are the fixing means and a drive source (not illustrated) of the reverse roller pair 47 which is the reverse means are provided independently. A pressure roller drive transmission gear 83 and a reverse roller drive transmission gear 84 which are members for transmitting drive power from the drive sources are integrally held by a gear holding plate 85 that is fixed to the image forming apparatus main body 10.

The pressure roller drive transmission gear 83 transmits drive power to the pressure roller drive gear 81, and the reverse roller drive transmission gear 84 drives the reverse roller drive gear 82. In addition, drive sources and drive gear trains (not illustrated) for driving the pressure roller 41 and the reverse roller 47*a* are disposed independently on the gear holding plate 85.

On the image forming apparatus main body side, in the gear holding plate 85 of the image forming apparatus main body in this example, positioning portions 85*a* and 85*b* for positioning the fixing unit 40A and the reverse roller unit 40B are provided. A fixing unit positioning boss 86 is protruded coaxially with the pressure roller drive gear 81, and a reverse roller unit positioning boss 87 is protruded coaxially with the reverse roller drive gear 82. The unit 40 is installed into the image forming apparatus main body 10 from a direction of an arrow B. The first positioning portion 85*a* and the second positioning portion 85*b* are formed of engaging grooves with which the bosses 86 and 87 can be detachably engaged, respectively. On entrance sides of the engaging grooves of the positioning portions 85*a* and 85*b*, slopes that are gradually inclined toward the grooves are formed to respectively guide the bosses 86 and 87.

FIG. 5 illustrates a state where the unit 40 is installed in the image forming apparatus. When the unit 40 is installed in the image forming apparatus main body 10, the fixing unit positioning boss 86 is positioned by the first positioning portion 85*a*, as a result of which the position of the fixing unit 40A is determined. Moreover, the reverse roller unit positioning boss 87 is positioned by the second positioning portion 85*b*, as a result of which the position of the reverse roller unit 40B is determined. The reverse roller unit 40B is openable and closable with respect to the fixing unit 40A about the rotating shaft 48*a*, and accordingly has a degree of freedom with respect to the fixing unit 40A. However, as a result of determining the position of the reverse roller unit 40B by the second positioning portion 85*b*, the position of the reverse roller unit 40B in an opening/closing direction is determined, too.

In FIG. 4, the reverse roller unit frame 48 is in contact with the fixing unit frame 44 of the fixing unit 40A. After the reverse roller unit frame 48 is installed and positioned in the image forming apparatus main body 10, there is a slight gap between the reverse roller unit frame 48 and the fixing unit frame 44 as illustrated in FIG. 5. Here, the pressure roller drive gear 81 meshes with the pressure roller drive transmission gear 83 disposed in the main body, and the reverse roller drive gear 82 meshes with the reverse roller drive transmission gear 84 disposed in the main body.

In a state where the unit 40 is removed from the image forming apparatus main body, the fixing unit 40A and the reverse roller unit 40B are only connected to each other at the connecting shaft 48*a*, so that the reverse roller unit 40B has a degree of freedom in its rotating direction and is rotatable. Once the fixing unit 40A and the reverse roller unit 40B are installed in the image forming apparatus main body 10, however, the positions of the fixing unit 40A and the reverse roller unit 40B are fixed, and the reverse roller unit 40B becomes not rotatable with respect to the fixing unit 40A.

The following describes a movement of a recording material in the case of continuous duplex printing in this embodiment, with reference to FIGS. 6 to 9. FIGS. 6 to 9 are enlarged schematic sectional views of the fixing unit 40A, the reverse roller unit 40B, the delivery unit 50, and their vicinity in the image forming apparatus.

Figure 6:
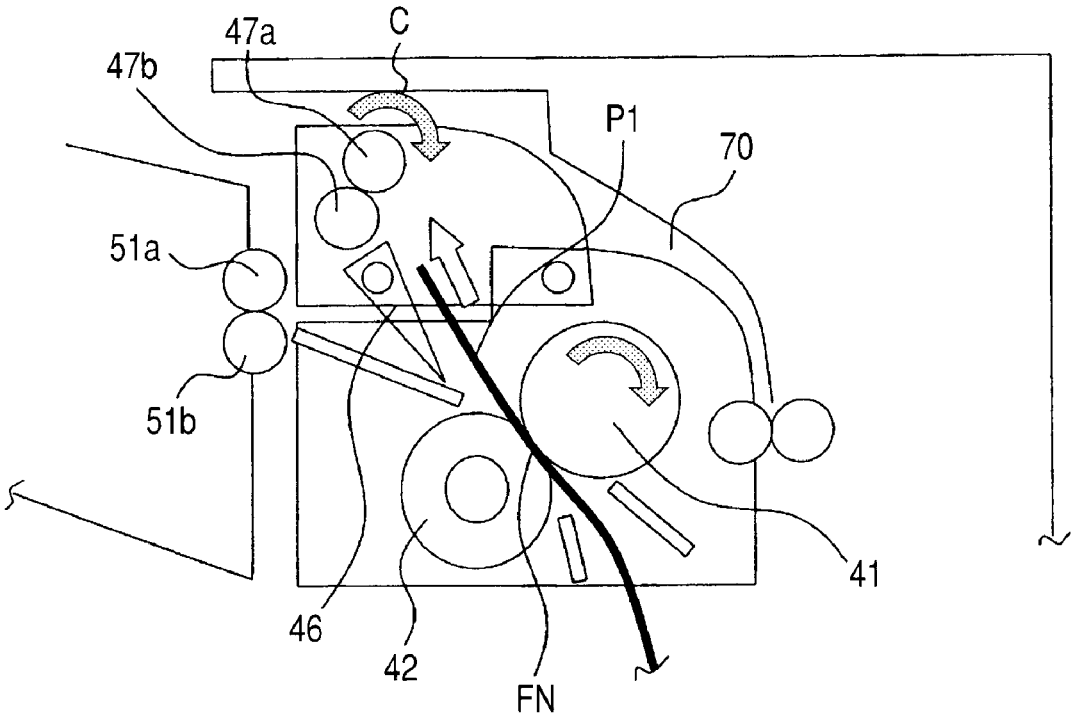
FIG. 6 illustrates a flow of movement of a recording material in duplex printing.

FIG. 6 illustrates a state where the first side of a recording material P1 has been printed, before printing on the second side. The recording material P1 which has passed through the fixing nip FN is conveyed to the reverse rollers 47*a* and 47*b* by the flapper 46. At this time, the flapper 46 faces downward so as to be at a position where the recording material P1 can be smoothly guided to the reverse rollers 47*a* and 47*b*.

Figure 7:
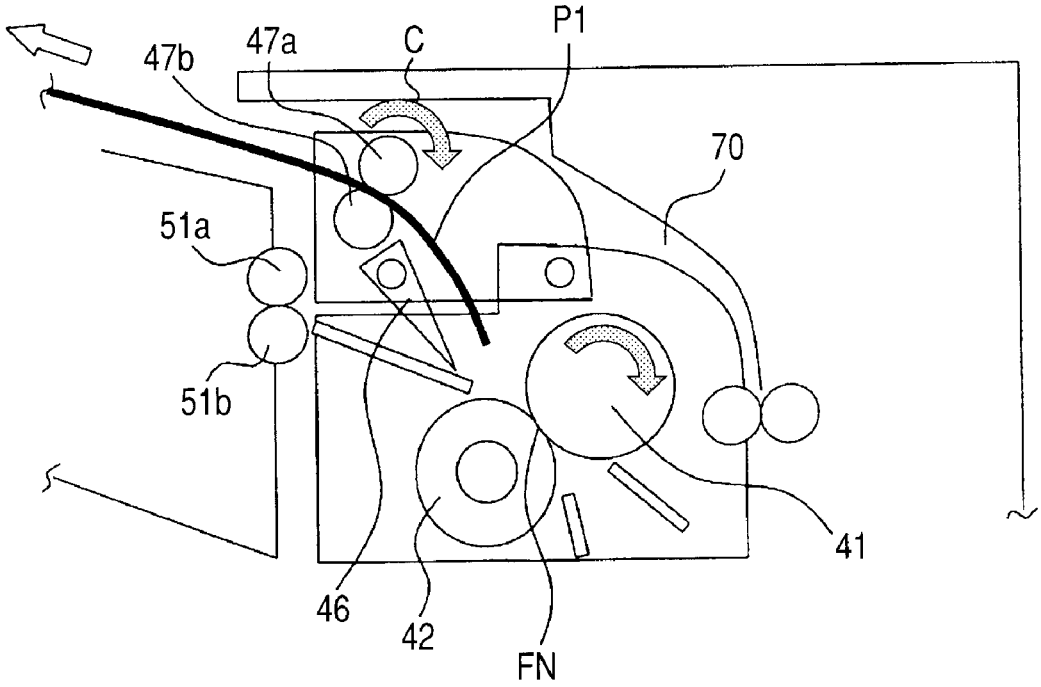
FIG. 7 illustrates the flow of movement of the recording material in duplex printing.
Figure 8:
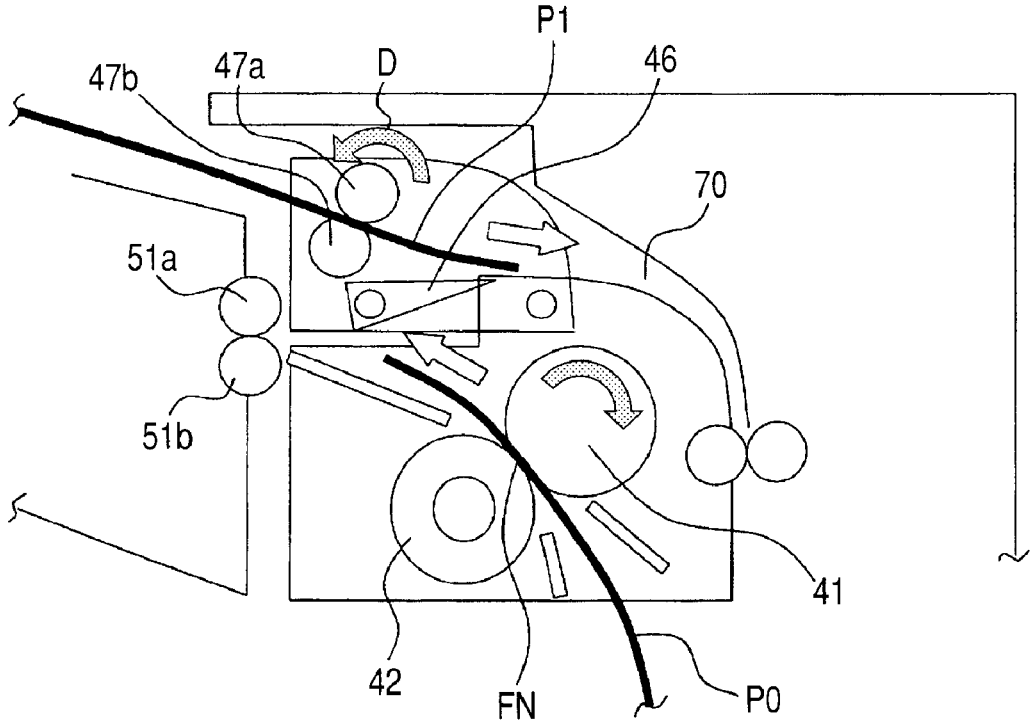
FIG. 8 illustrates the flow of movement of the recording material in duplex printing.

In FIG. 7, the reverse rollers 47*a* and 47*b* rotate in a direction of an arrow C, until a rear end of the recording material P1 comes out of the fixing nip FN. After the rear end of the recording material P1 comes out of the fixing nip FN, the flapper 46 rotates upward, and the reverse rollers 47*a* and 47*b* rotate backward in a direction of an arrow D to convey the recording material P1 to the duplex conveying guide 70, as illustrated in FIG. 8. Thus, after conveying the recording material which has passed through the fixing nip in the same direction as the conveying direction at the fixing nip, the reverse rollers rotate backward to convey the recording material to the image forming portions again.

Figure 9:
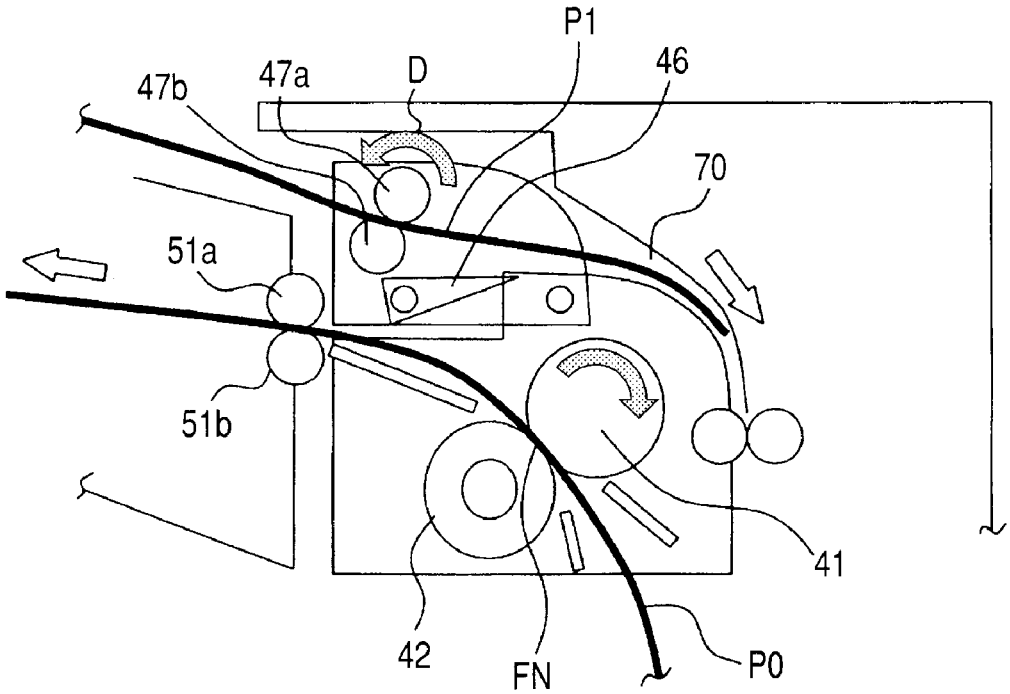
FIG. 9 illustrates the flow of movement of the recording material in duplex printing.
Figure 10:
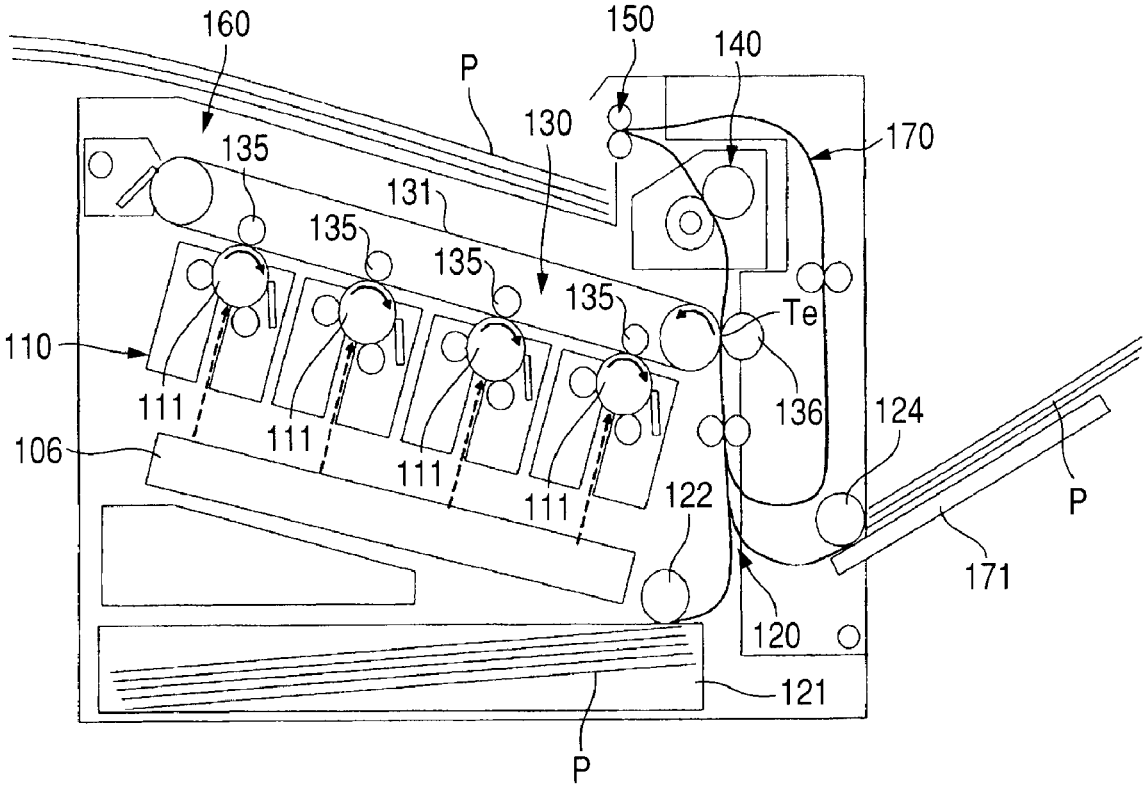
FIG. 10 is a schematic sectional view of an image forming apparatus in which delivery rollers also function as reverse rollers.
Figure 11:
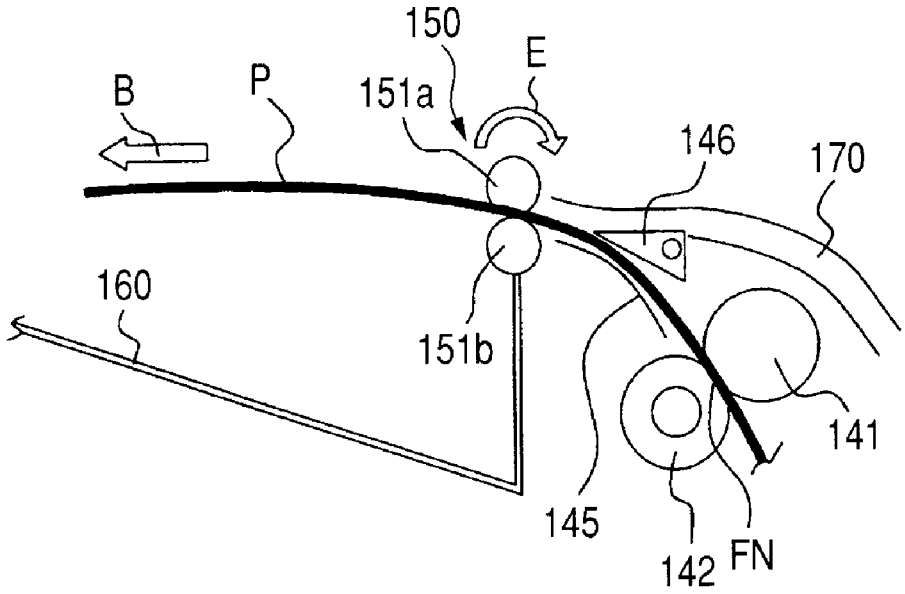
FIG. 11 illustrates a flow of movement of a recording material in the image forming apparatus in which the delivery rollers also function as the reverse rollers.
Figure 12:
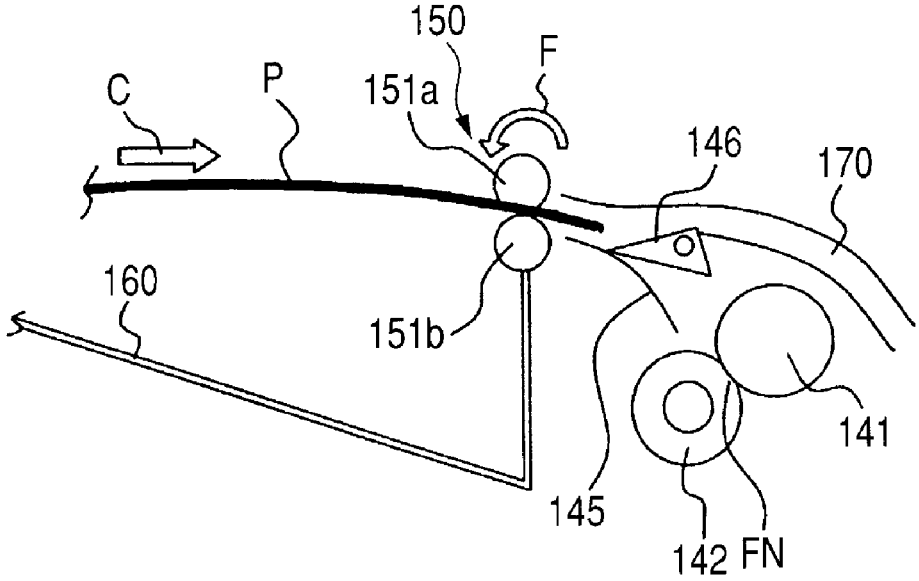
FIG. 12 illustrates the flow of movement of the recording material in the image forming apparatus in which the delivery rollers also function as the reverse rollers.

At this time, the next recording material P0 (the second side of which has already been printed) has already started passing through the fixing nip FN, and is conveyed to the delivery rollers 51*a* and 51*b* in such a manner as to pass by the recording material P1. After this, as illustrated in FIG. 9, the recording material P0 is delivered to the outside of the apparatus by the delivery rollers 51*a* and 51*b*, and the recording material P1 is fed again via the duplex conveying guide 70 in order to print on the second side.

As described above, according to this embodiment, the fixing unit 40A and the reverse unit 40B are integrally connected to each other, so that the alignment of the fixing unit 40A and the reverse unit 40B can be maintained with high precision. In other words, the alignment between the reverse rollers 47*a* and 47*b* in the reverse unit 40B and the pressure roller 41 and the fixing roller 42 in the fixing unit 40A can be maintained with high precision. Therefore, a deviated loop of the recording material P caused by alignment deterioration between these rollers can be suppressed. Hence it is possible to prevent poor imaging due to a sheet jam and a skew feeding of the recording material P.

The unit 40 is removable from the image forming apparatus main body, while leaving the delivery roller unit 50 in the image forming apparatus main body. This causes a decrease in relative position precision between the fixing unit 40A and the delivery roller unit 50, when compared with a structure of integrating the fixing unit 40A and the delivery roller unit 50. However, given that the recording material conveyed to the delivery roller unit 50 is delivered outside of the apparatus main body without returning into the apparatus main body, the relative position precision between the fixing unit 40A and the delivery roller unit 50 may be more compromised than the relative position precision between the fixing unit 40A and the reverse roller unit 40B. Moreover, the delivery roller unit 50 is fixed to the image forming apparatus main body, and the unit that is removable from the image forming apparatus main body is limited only to the fixing unit 40A and the reverse roller unit 40B. This contributes to a reduction in cost when exchanging the fixing unit 40A which has reached the end of its life.

Furthermore, the fixing unit frame 44 of the fixing unit 40A and the reverse roller unit frame 48 of the reverse unit 40B are formed so as to be positioned in the image forming apparatus main body 10. This enables the drive transmission from the image forming apparatus main body 10 to be performed accurately. Hence problems such as a drive failure, a gear abrasion, and drive noise can be effectively suppressed.

Figure 13:
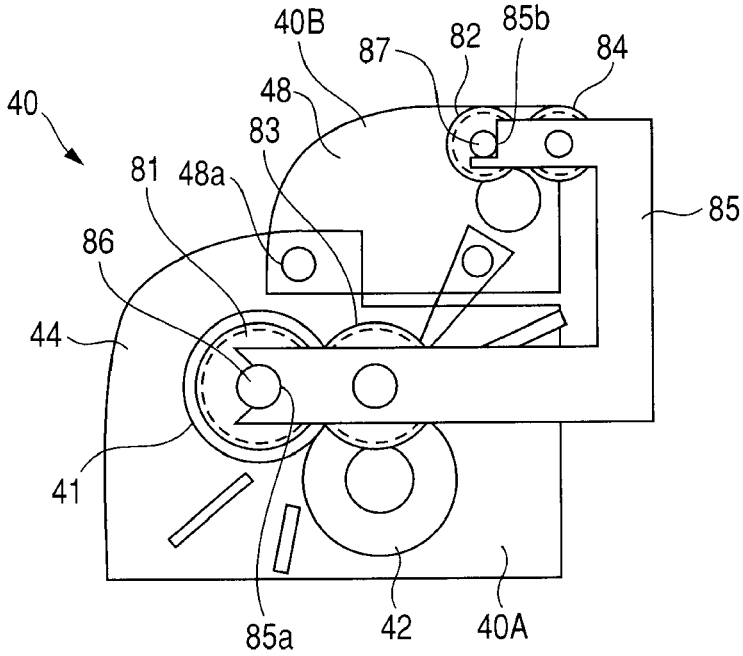
FIG. 13 is a sectional view of a fixing unit and its vicinity in an image forming apparatus of a modification of the present invention.
Figure 14:
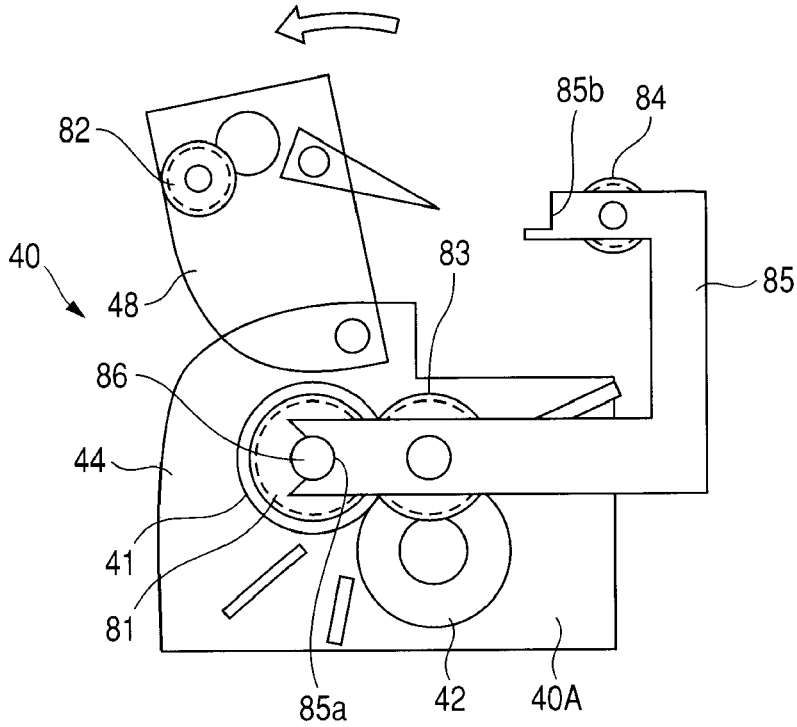
FIG. 14 is a sectional view of the fixing unit and its vicinity in the image forming apparatus of the modification of the present invention.

As illustrated in FIGS. 13 and 14, it is also possible to use a structure in which, after installing the unit 40 including the fixing unit 40A and the reverse roller unit 40B in the image forming apparatus main body, the reverse roller unit 40B can be released from the fixing unit 40A. In such a structure, the reverse roller unit frame 48 substantially rotates about the connecting shaft 48*a* with respect to the fixing unit frame 44, so that the fixing nip FN can be sufficiently exposed. This eases jam recovery for a sheet jam and the like which occur in the unit 40.

Moreover, by providing the reverse unit 40B and the delivery unit 50 independently of each other, the sheet interval at the time of continuous sheet feed in duplex printing can be minimized. Hence enhanced productivity can be attained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-201947, filed Aug. 5, 2008, which is hereby incorporated by reference herein in its entirety.

What is claimed is:

1. An image forming apparatus comprising:

a main body;

an image forming portion for forming a toner image on a recording material;

a fixing unit for fixing the toner image on the recording material and including a nip forming member which forms a fixing nip that nips and conveys the recording material;

a reverse roller unit including a reverse roller, and said reverse roller backward rotatable to convey the recording material to said image forming portion again after conveying the recording material which has passed through the fixing nip in a same direction as a conveying direction at the fixing nip; and a delivery roller for delivering the recording material which has passed through the fixing nip, out of said main body, wherein said reverse roller unit is attached to said fixing unit, and is removably installable in said main body integrally with said fixing unit, wherein said reverse roller unit is attached so as to be openable and closable with respect to said fixing unit, wherein said main body includes a first positioning portion and a second positioning portion, and wherein, when an integral unit of said fixing unit and said reverse roller unit is installed in said main body, said fixing unit is positioned with respect to said first positioning portion, and said reverse roller unit is positioned with respect to said second positioning portion.

* * * * *